United States Patent [19]

Poterala et al.

[11] 4,021,894

[45] May 10, 1977

[54] TEXTILE SPREADER ROLLER

[75] Inventors: Robert J. Poterala, Simpsonville; Marshall C. Richards, Taylors, both of S.C.

[73] Assignee: Crompton & Knowles Corporation, Worcester, Mass.

[22] Filed: June 30, 1975

[21] Appl. No.: 591,562

[52] U.S. Cl. ..... 26/105; 29/121.4; 29/121.2; 29/148.4 D

[51] Int. Cl.[2] ..... D06C 3/06

[58] Field of Search ..... 26/63, 105; 29/121 H, 29/148.4 D; 226/193; 139/296; 162/271

[56] References Cited

UNITED STATES PATENTS

| | | | |
|---|---|---|---|
| 504,927 | 9/1893 | Mather | 26/63 |
| 1,457,276 | 5/1923 | Isherwood | 26/63 |
| 1,568,401 | 1/1926 | Griffith | 26/63 |
| 2,338,847 | 1/1944 | Hansen | 29/148.4 D |
| 3,412,446 | 11/1968 | Wood | 29/148.4 D |

FOREIGN PATENTS OR APPLICATIONS

| | | | |
|---|---|---|---|
| 12,754 | 1887 | United Kingdom | 29/121 H |

*Primary Examiner*—Robert R. Mackey
*Attorney, Agent, or Firm*—Howard G. Garner, Jr.; Wilfred F. DesRosiers

[57] ABSTRACT

A spreader roller for textiles which is fabricated by positioning a smooth cylindrical supporting member coaxially within a corrugated tube having inner and outer helical ridges, the outer ridges on one longitudinal half of the tube being of opposite hand to the outer ridges on the other half of the tube. The corrugated tube is fastened to the supporting member along the inner helical ridges, preferably by plug welding at spaced points along the inner ridges.

6 Claims, 12 Drawing Figures

26
18
20
16
60
15
61
62
28
50
52
34
36
40
32
38
63
22

TEXTILE SPREADER ROLLER

BACKGROUND OF THE INVENTION

The present invention relates generally to spreader rolls for textiles and specifically to spreader rolls which are provided on their circumference with screw threads which are right handed on one longitudinal half of the roller and left handed on the other longitudinal half. This provides an expanding action on cloth or other textile material which is moved over the rollers.

In the past, spreader rollers have been made by cutting threads into a cylinder or by helically winding an elongated flexible element around a cylinder and fastening it to the cylinder.

Spreader rollers having threads which have been cut continue to be very costly to manufacture. Spreader rollers which contain threads fabricated onto a cylinder have not performed satisfactorily due to the flimsiness of the thread or to the sharp edges which are a result of the thread fabrication.

SUMMARY OF THE INVENTION

It is a principal object of the present invention to provide a novel spreader roller and method for making same which is less expensive, more reliable, and operates more satisfactorily than prior art rollers.

The principle object of the present invention is accomplished by forming a spreader roll from spirally corrugated tubing. This tubing is the type which can be manufactured in a manner shown in U.S. Pat. Nos. Re 24,783 to R.P. Humphrey; 3,015,355 to A.H. Humphrey; and 3,533,267 to T.R. Bunnell. As disclosed in the above patents, spirally corrugated tubes are made by twisting a seamless of metal, or other deformable material, against an inserted mandrel. The twisting is done by grasping the tube at two axially spaced points and by rotating at one grasped point relative to the other grasped point.

Corrugated tubing of the type described above is relatively inexpensive to manufacture and the thread surfaces are continuous with the valley surfaces therebetween so that there are no sharp edges to damage the textile material being expanded. It is also possible, if desired, to make the threads multiple pitch by the above process.

The spreader rollers of the present invention is made by fastening one end of a corrugated tube of the type described above to the end of a second corrugated tube to make a composite corrugated tube. The tubes are joined in such a way that the threads on one longitudinal half of the composite corrugated tube are of opposite hand from the threads on the other half thereof. The preferred method of fastening the two corrugated tubes is by welding, although a strong adhesive may be used. It is also preferred that the ends of the corrugated tubes have smooth inner and outer surfaces so that the ends will match and from a stronger bond between the two abutting end surfaces. Since the corrugated tubes used with the present invention are relatively thin walled, a cylindrical supporting member is positioned within the composite corrugated tube in coaxial realtionship therewith. The supporting member has a smooth outer surface which abuts the inner ridges of the composite corrugated tube. The supporting member is then fastened to the composite corrugated tube along the inner ridges which are also the valleys between the outer ridges. It is preferred that the composite corrugated tube and supporting member be fastened by plug welding. Spot welding, or adhesives, could also be used for fastening. Plug welding is accomplished by drilling spaced holes through the wall of the corrugated tube along the valleys between the outer ridges and thereby exposing portions of the outer surface of the supporting member which lie beneath the inner ridges. These exposed surfaces are then welded to the composite corrugated tube by filling the holes with welding material or forming a "weld plug".

It is also preferred that the cylindrical supporting member be tubular with journals attached to the ends thereof.

BRIEF DESCRIPTION OF THE INVENTION

Other features and advantages of the invention will become more apparent upon reading of the detailed description of the invention together with the drawings in which.

DETAILED DESCRIPTION OF THE INVENTION

Figures 1, 2, 3, 4:
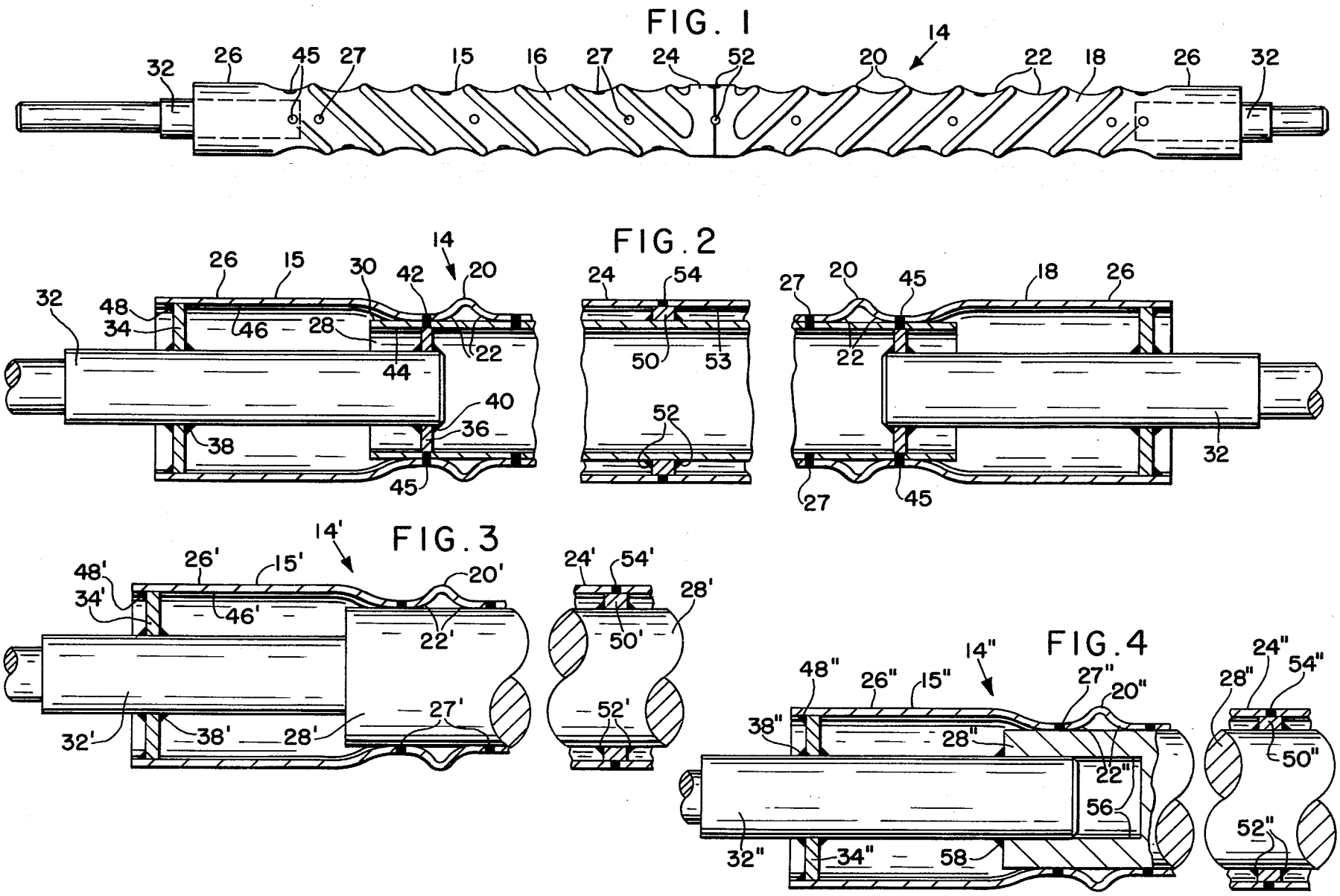
FIG. 1 is a plan view of the preferred embodiment of a spreader roller made in accordance with the present inventon.
FIG. 2 is a sectional view of the roller in FIG. 1 taken along the central longitudinal axis thereof and shown on an enlarged scale with portions broken away.
FIG. 3 is a fragmentary section of a first modified spreader roller.
FIG. 4 is a fragmentary section of a second modified spreader roller.

Referring to FIGS. 1 and 2, there is shown the preferred form of spreader roller made in accordance with the present invention and generally indicated by the reference numeral 14. Spreader roller 14 comprises a composite corrugated tube 15 having two longitudinal half portions indicated at 16 and 18. Portions 16 and 18 each have outer helical ridges 20 and inner helical ridges 22 which are formed by the valleys between outer ridges 20. The helical ridges 20 on portion 16 are of opposite hand to those on portion 18 to create an outward spreading action for a textile material which is passed over the spreader roller as part of certain type of textile operations. Corrugated tube 15 has a smooth central section 24 and smooth end sections 26.

Spreader roller 14 also includes a tubular supporting member 28 which has a smooth outer surface 30 and is positioned axially within the composite corrugated tube 15 in abutting relationship with the inner ridges 22. Tubular supporting member 28 is fastened to the composite corrugated tube 15 by plug welds 27 at spaced points along the inner ridges 22.

At each end of spreader roller 14 there is a journal 32 which extends partially into supporting member 28 and extends beyond the end of the corrugated tube 15. Journal 32 is held axially within supporting member 28 and corrugated tube 15 by an outer circular hub 34 and an inner circular hub 36. Hubs 34 and 36 circumscribe journal 32 and are fastened thereto by welds 38 and 40, respectively. Inner hub 36 is located at the inner end of journal 32 and its outer circumference, indicated at 42, abuts the inner surface 44 of supporting member 28. Hub 36 is fastened to supporting member 28 and corrugated tube 26 by plug welds 45 at spaced points along the circumference of hub 36. Hub 34 has a larger outer diameter than hub 36 and abuts the inner surface 46 of the smooth portion 26 of corrugated tube 15 and is fastened to surface 46 by welds 48. There is a central hub 50 which circumscribes supporting member 28 and is fastened thereto by welds 52. Central hub 50 abuts the inner surface 53 of the smooth central portion 24 of tube 15 and is fastened thereto by plug welds 54.

Referring to FIG. 3, there is shown a first modified spreader roller 14' which includes a corrugated tube 15' which is identical, in all respects, to tube 15. Roller 14' includes outer and inner helical ridges 20' and 22', respectively, and smooth central and end sections 24' and 26', respectively. Spreader roller 14' includes a solid cylindrical supporting member 28' located axially within corrugated tube 15' and is fastened directly to corrugated tube 15' by plug welds 27' located at spaced points along the inner ridges 22' of corrugated tube 15'. Supporting member 28' has a reduced portion 32' at each end thereof which function as journals. Only one reduced end portion 32' is shown in FIG. 3, since the other end is identical. An outer hub 34' circumscribes reduced portion 32' and is fastened thereto by welds 38'. The outer circumference of hub 34' abuts the indide surface 46' of the smooth end section 26' of corrugataed tube 15' and is fastened to surface 46 by welds 48'. There is also a central hub 50' which circumscribes the central portion of supporting member 28' and is fixed thereto by welds 52'. The outer circumference of central hub 50' abuts the inner surface of the central smooth section 24' and is fastened thereto by plug welds 54'.

Referring to FIG. 4, there is shown a second modification of a spreader roller indicated generally by the reference numeral 14'' and includes a composite corrugated tube 15'' which is identical to tube 15 in every respect. Tube 15'' includes helical outer and inner ridges 20'' and 22'', respectively, smooth end sections 26'' and a smooth central section 24''. Spreader roller 14'' also comprises a tubular supporting member 28'' located axially within corrugated tube 15'' and fastened thereto by plug welds 27'' at spaced points along the inner ridges 22''. Located at each end of supporting member 28'' is a journal 32'' which fits snugly within the bore 56 of supporting member 28'' and is fastened thereto by welds 58. Since both journals 32'' are identical, only the left-hand journal is illustrated in FIG. 4. An outer hub 34'' circumscribes journal 32'' by welds 38''. The outer circumference of hub 34'' abuts the inside surface of the smooth section 26'' of corrugated tube 15'' and is fastened thereto by welds 48''. A central hub 50'' circumscribes the central portion of supporting member 28'' and s fastened there by welds 52''. Hub 50'' abuts the inside surface of the central smooth section 24'' and is fastened thereto by plug welds 54''.

Figures 5, 6, 7, 8, 9, 10, 11, 12:
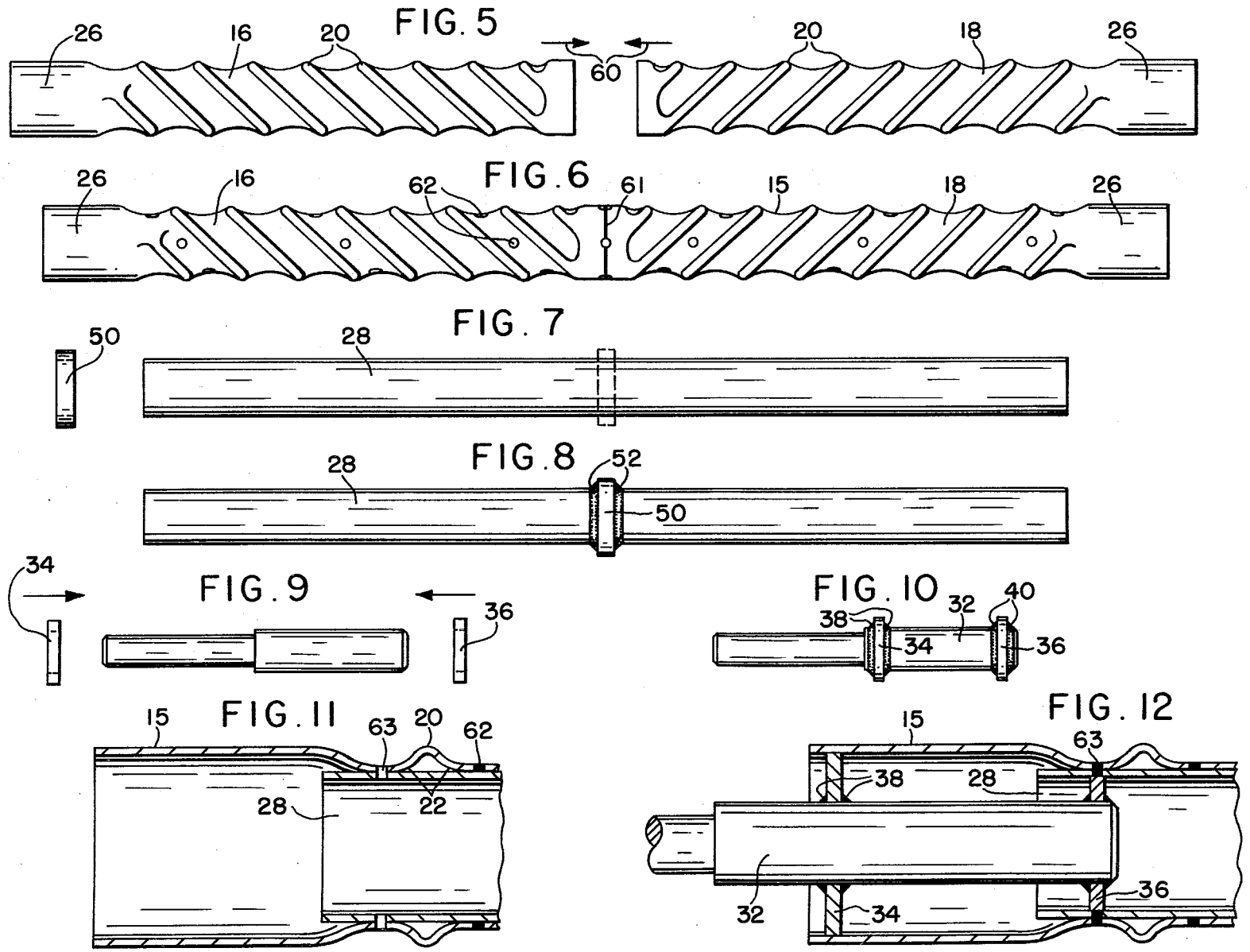
FIG. 5–12 illustrate the steps of making the preferred spreader roller shown in FIG. 1.

Referring to FIGS. 5 through 12, there is illustrated the steps of fabricating the preferred spreader roller of FIGS. 1 and 2. In FIG. 5, the two longitudinal half portions 16 and 18 of corrugated tube 15 are shown as separate identical corrugated tubes having smooth portions at each end thereof. Tube portions 16 and 18 are brought together end to end in the direction of arrows 60 so that their respective outer helical ridges 20 are of opposite hand. The abutting ends of tubes 16 and 18 are then welded to form a weld seam 61, as shown in FIG. 6, and thereby forming the composite corrugated tube 15, including smooth end portions 26 and smooth central portion 24. Holes 62 are drilled through the wall of tube 15 at spaced points along the inner ridges 22 and along the circumference of welds seam 61.

Referring to FIGS. 7 and 8, the tubular supporting member 28 is prepared by sliding the central hub 50 over the end of supporting member 28 to the center thereof and welding it thereto by welds 52.

Referring to FIGS. 9 and 10, each journal 32 is prepared by sliding hubs 34 and 36 over opposite ends of journal 32, as shown in FIG. 9, and welding them to the journals by welds 38 and 40, respectively, as shown in FIG. 10. Only the left-hand journal is illustrated in FIGS. 9 and 10, it being understood that the right-hand journal is prepared in exactly the same manner. As illustrated in FIG. 11, supporting member 28 with the central hub 50 attached thereto is inserted axially within composite corrugated tube 15. Supporting member 28 is attached to tube 15 by plug welding within holes 62. Holes 63 are drilled through the walls of tube 15 and supporting member 28 at points along a circumferential circle near each end of the supporting member. The journals 32 are than inserted axially within the ends of supporting member 28 so that inner hubs 36 are aligned with holes 63, as illustrated in FIG. 12. The structure illustrated in FIG. 12 is ready to be completed by plug welding through holes 63 and welding along the outer circumference of outer hubs 34.

We claim:

1. A spreader roller for textiles comprising: a. a corrugated tube seamless along its longitudinal axis having inner and outer helical ridges, the outside of said tube having at least one helical ridge on each longitudinal half of the tube, the outer ridge on one longitudinal half of said tube being of opposite hand to the outer ridge on the other longitudinal half of the tube;

b. a cylindrical supporting member positioned within said corrugated tube in substantially coaxial relationship therewith and having a smooth outer surface in abutting relationship with the inner ridges of said corrugated tube; and c. means for fastening said corrugated tube to said supporting member along said inner ridges.

2. A spreader roller as set forth in claim 1 wherein said supporting member is a shaft which extends beyond the ends of said corrugated tube.

3. A spreader roller as set forth in claim 1 wherein said supporting member is tubular and comprises a journal at each end thereof which extend beyond the ends of said corrugated tube.

4. A spreader roller as set forth in claim 1 wherein said supporting member is tubular and each end of said corrugated tube includes a portion which extends beyond said supporting member, each of said extending portions having smooth inner and outer surfaces, said spreader roller further comprising at each end thereof:

a. a journal which partially extends into the end of said supporting member and beyond the end of said corrugated tube and which has a smaller diameter than the inner diameter of said supporting member;

b. an inner circular hub fixed to the inner end of said journal and fastened to said corrugated tube and supporting member along its circumference; and c. an outer circular hub fixed to said journal at a point between said inner hub and the end of said corrugated tube and fastened to said corrugated tube at spaced points along its circumference.

5. A spreader roller as set forth in claim 4 wherein said corrugated tube has a smooth central portion spaced from said supporting member and said spreader roller comprises:

a. a circular central hub which circumscribes and is fixed to said supporting member in abutting relationship with the inner surface of said smooth central portion; and b. means for fastening said central hub to said corrugated tube along the circumference of said central hub.

6. A spreader roller as set forth in claim 5 wherein the means for fastening said corrugated tube to said supporting member and said inner, central and outer circular hubs to said corrugated member comprise welds.

* * * * *